US006612817B2

(12) United States Patent
Lin et al.

(10) Patent No.: US 6,612,817 B2
(45) Date of Patent: Sep. 2, 2003

(54) SERIAL FAN

(75) Inventors: Kuo-Cheng Lin, Taoyuan (TW); Shun-Chen Chang, Taipei (TW); Chih-Yuan Lin, Shinjuang (TW); Shou-Te Yu, Taoyuan (TW)

(73) Assignee: Delta Electronics Inc., Taiwan (TW)

( * ) Notice: Subject to any disclaimer, the term of this patent is extended or adjusted under 35 U.S.C. 154(b) by 0 days.

(21) Appl. No.: 09/796,351

(22) Filed: Mar. 2, 2001

(65) Prior Publication Data

US 2002/0122733 A1 Sep. 5, 2002

(51) Int. Cl.[7] ..... F04B 17/03

(52) U.S. Cl. ..... 417/423.5; 417/360; 415/199.5; 415/213.1; 416/198 R

(58) Field of Search ..... 417/423.5, 350, 417/354, 360; 415/58.7, 59.1, 190, 193, 199.4, 199.5, 208.2, 208.4, 209.1, 108, 213.1, 211.2; 416/198 R, 244 R; 403/83, 97, 348, 352

(56) References Cited

U.S. PATENT DOCUMENTS 3,644,066 A * 2/1972 Heob et al. ..... 417/354
5,133,617 A * 7/1992 Sokn et al. ..... 403/349
5,407,324 A * 4/1995 Starnes, Jr. et al. ..... 415/208.5
5,498,130 A * 3/1996 Wakley et al. ..... 415/213.1
5,839,205 A * 11/1998 Hung ..... 34/97
6,244,818 B1 * 6/2001 Chang ..... 415/208.2
6,375,440 B2 * 4/2002 Kosugi ..... 417/423.14

* cited by examiner

*Primary Examiner*—Charles G. Freay
*Assistant Examiner*—Han L. Liu
(74) *Attorney, Agent, or Firm*—Birch, Stewart, Kolasch & Birch, LLP

(57) ABSTRACT

A serial fan which only occupies a small space, has a simplified assembling structure, and can effectively eliminate the interference between fans. The serial fan include a main frame, a plurality of rotor vanes connected in series within the main frame along an axial direction of the serial fan, a first support disposed inside and connected with the main frame for supporting one of the plurality of rotor vanes, and a second support detachably connected with the first support for supporting another one of the plurality of rotor vanes.

33 Claims, 8 Drawing Sheets

SERIAL FAN

FIELD OF THE INVENTION

The present invention is related to a serial fan, and more particularly to an axial-flow fan with a plurality of rotor vanes connected in series in a single fan guard.

BACKGROUND OF THE INVENTION

The axial-flow fan is a popular fan device which has the features of a simple structure, low cost, and a high airflow rate. Therefore, it has been widely used in various systems as an air conditioning or ventilating device, for instance, as a ventilation fan in a computer system.

Generally, in order to avoid the interruption of operation due to the breakdown of fans, a set of standby fan system is usually provided and connected with the original fan system in series to prevent the system or device from being damaged. Moreover, because the total pressure of the axial-flow fan is relatively low, the axial-flow fan cannot fully develop a high airflow rate in a system of a high resistance. Thus, in the case that a high total pressure is needed, two or more axial-flow fans are connected in series to provide the high total pressure.

Typically, a so-called serial fan is constituted by two independent fan units assembled through a specific circuit design. Each fan unit includes a fan guard and a rotor device. As shown in FIG. 1, the first fan unit is constructed by a fan guard 13 and a rotor device including a motor 11, and a rotor vane 12 having a shaft ring 121 connected to the motor 11 and a plurality of blades 122 fixed on the circumferential surface of the shaft ring 121. Likewise, the second fan unit is constructed by a fan guard 16 and a rotor device including a motor 14, and a rotor vane 15 having a shaft ring 151 connected to the motor 14 and a plurality of blades 152 fixed on the circumferential surface of the shaft ring 151. After the first and second fan units are assembled respectively, both of them are coupled together through screws (not shown), thereby completing the construction of the serial fan. However, such a design is more complicated and needs more time and manufacturing cost in the assembly of this serial fan.

In fact, according to the above description, it can be found that the conventional serial fan is constructed by two independent fan units connected in series. However, the serial connection of two fan units can not guarantee that the total pressure of the airflow discharged from the fan can be doubled. Even if only one fan operates and the other still stays as a standby fan, the latter will reduce the total pressure in operation because the resistance between both of them is increased, thereby decreasing their operating efficiency. For example, when the airflow flows through these two fan guards 13, 16 having the structures as shown in FIG. 1 and as described, the airflow will encounter a plurality of ribs 131, 161, thereby resulting in the generation of turbulent flows and an adverse effect on the blast pressure enhancement. Consequently, the heat-dissipating efficiency of the fan is reduced. Thus, in certain situations, the two axial-flow fans connected in series are separated far apart to minimize the interference between them. Nevertheless, this way can not be applied in the case that the space is limited.

Therefore, it is desirable to develop an axial-flow serial fan with a plurality of rotor vanes that only occupies a small space, has a simplified structure, and can effectively eliminate the interference between two fans.

SUMMARY OF THE INVENTION

An object of the present invention is to provide a serial fan which can be assembled easily, fastly and conveniently, and has a strengthened bonding structure.

Another object of the present invention is to provide an axial-flow fan having a plurality of rotor vanes connected in series in a single fan guard, which can effectively eliminate the interference between fans.

According to the present invention, the serial fan includes a main frame, a plurality of rotor vanes connected in series within the main frame along an axial direction of the serial fan, a first support disposed inside and connected with the main frame for supporting one of the plurality of rotor vanes, and a second support detachably connected with the first support for supporting another one of the plurality of rotor vanes.

In accordance with one aspect of the present invention, the first support includes a first engaging member disposed on a base thereof and the second support includes a second engaging member disposed on a base thereof to be engaged with the first engaging member for tightly assembling the first support and the second support together. The first engaging member includes a plurality of retaining grooves formed on the base of the first support and the second engaging member includes a plurality of hook structures to be received by the plurality of retaining grooves, respectively. Certainly, the structure of the first engaging member can be exchanged with that of the second engaging member.

In addition, the base of the first support has a flange and the base of the second support has an outwardly extended peripheral wall, the outer diameter of which is slightly smaller than the inner diameter of the flange of the first support such that the bases of the first and second supports are engaged with each other. Alternatively, the base of the second support has a flange and the base of the first support has an outwardly extended peripheral wall, the outer diameter of which is slightly smaller than the inner diameter of the flange of the second support such that the bases of the first and second supports are engaged with each other.

In accordance with another aspect of the present invention, the serial fan further includes a plurality of motors respectively received by the first and second supports for driving the plurality of rotor vanes to rotate.

Preferably, the serial first support has a base and a hollow cylinder substantially located at a center of the base for receiving one of the plurality of motors and the one of the plurality of rotor vanes. Likewise, the second support also has a hollow cylinder substantially located at a center of a base thereof for receiving another one of the plurality of motors and another one of the plurality of rotor vanes. The second support can be made of plastic or metal.

In accordance with another aspect of the present invention, the first support is connected with the main frame through a plurality of guard blades radially arranged inside the main frame and fixed onto an inner surface of the main frame by each end thereof. Each of the plurality of guard blades has a shape substantially identical to that of each blade of the plurality of the rotor vanes for enhancing a heat-dissipating efficiency. Preferably, the first support, the main frame and the plurality of guard blades are integrally formed together and can be made of plastic and metal, respectively.

In another preferred embodiment of the present invention, the serial fan further includes a separator for preventing a magnetic field interference between two adjacent motors. The separator can be disposed between one of the first and second supports and one of the plurality of motors, or between the first support and the second support, Preferably, the separator is a metal plate. More preferably, the separator is an adhesive tape containing a metallic component to be directly attached to a base of the first support or the second support.

The present invention may best be understood through the following description, with reference to the accompanying drawings which are given by way of illustration only, and thus are not limitative of the present invention, and in which:

DETAILED DESCRIPTION OF THE PREFERRED EMBODIMENT

The present invention will now be described more detailedly with reference to the following embodiments. It is to be noted that the following descriptions of the preferred embodiments of this invention are presented herein for the purpose of illustration and description only. It is not intended to be exhaustive or to be limited to the precise form disclosed.

Figure 1:
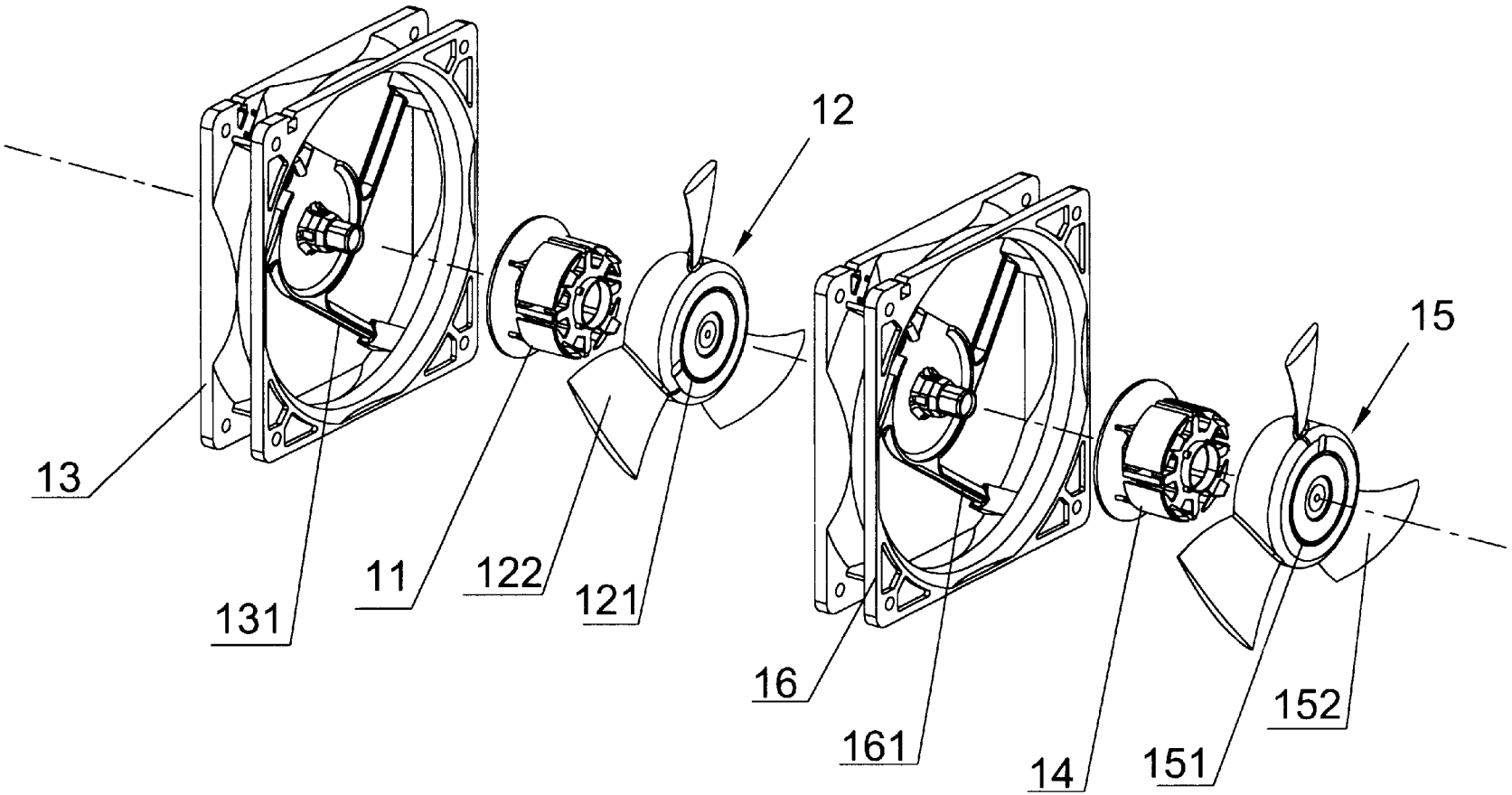
Fig. 1 (Prior Art)
FIG. 1 is an exploded diagram showing a conventional serial fan.
Figure 2:
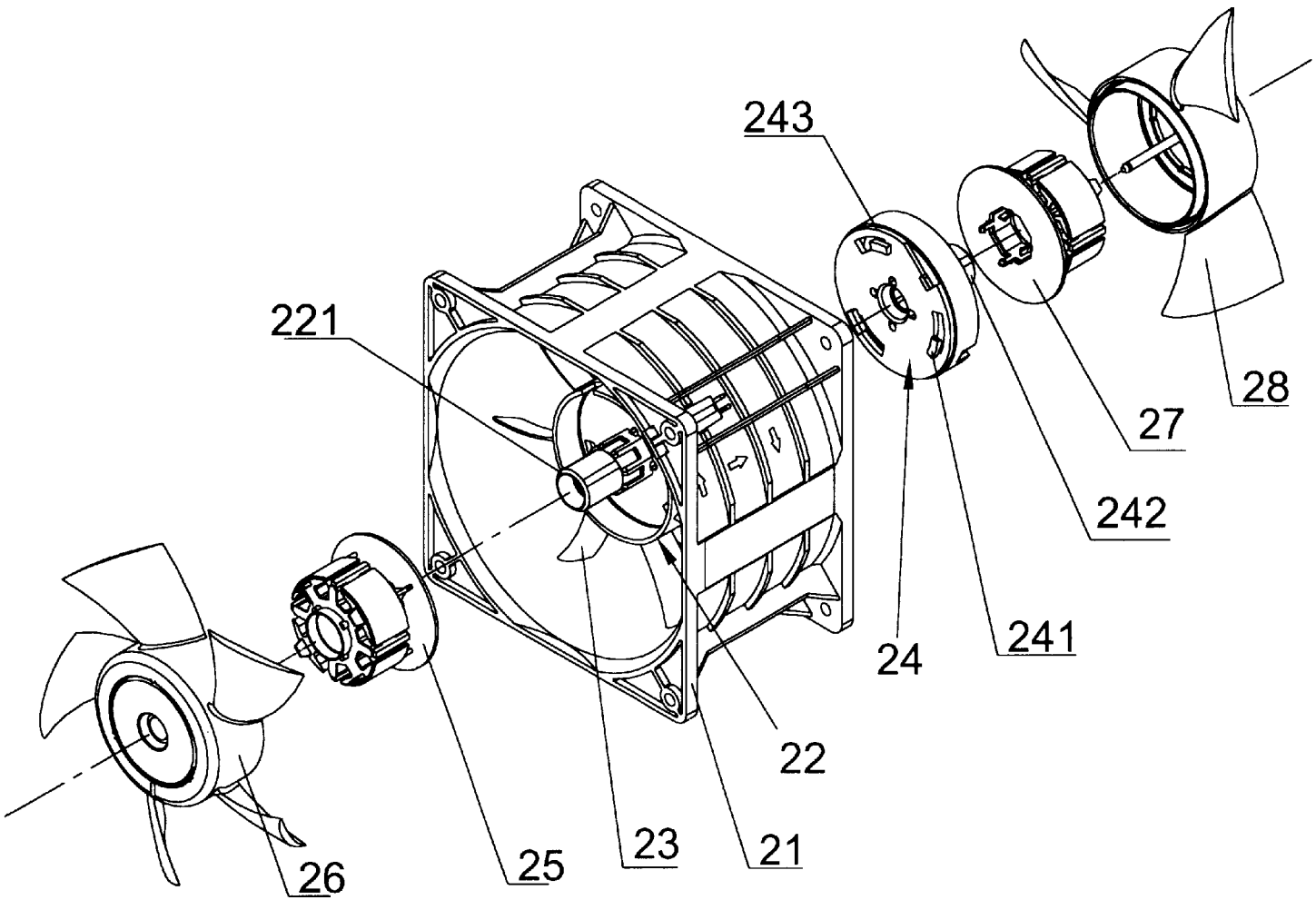
FIG. 2 is an exploded diagram showing the first preferred embodiment of a serial fan according to the present invention.

Please refer to FIG. 2 which is an exploded diagram showing the first preferred embodiment of a serial fan according to the present invention. The serial fan includes a main frame 21, a first rotor vane 26, a second rotor vane 28, two motors 25, 27, a first support 22, and a second support 24. The first rotor vane 26 and the second rotor vane 28 have a plurality of blades formed around their outer side, respectively.

The first support 22 is connected and fixed within the main frame 21 through a plurality of guard blades 23 which are radially arranged inside the main frame 21 and fixed onto an inner surface of the main frame 21 by each end thereof. Each of the plurality of guard blades has a shape substantially identical to that of each blade of the rotor vanes to increase the discharged airflow pressure of the fan for enhancing the heat-dissipating efficiency. The first support, the main frame and the plurality of guard blades can be integrally formed together and can be made of plastic, metal or a material other than plastic and metal for a desired purpose, respectively.

Figure 3B:
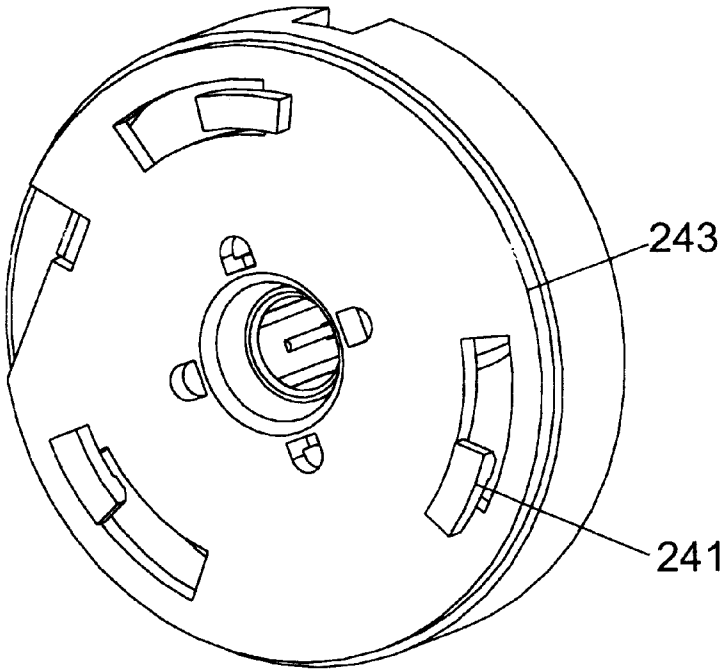
FIG. 3*b* is a bottom perspective view of a second support of the serial fan according to the present invention.
Figure 3A:
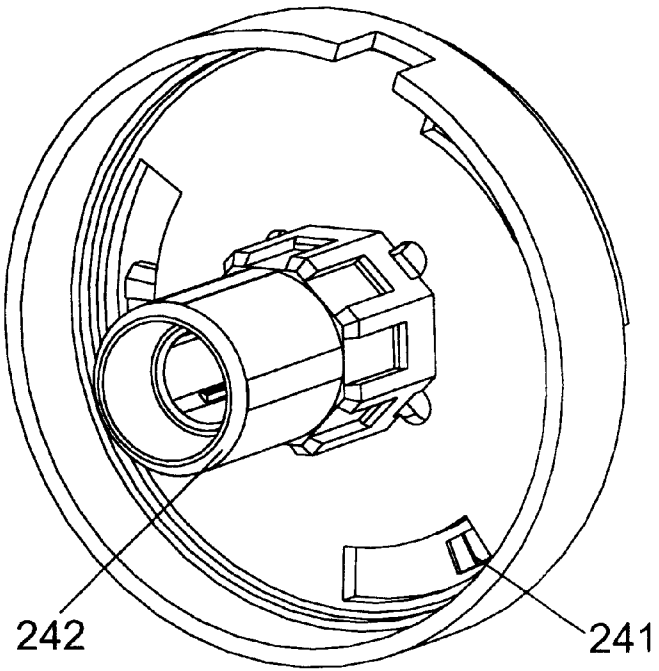
FIG. 3*a* is a top perspective view of a second support of the serial fan according to the present invention.
Figure 4A:
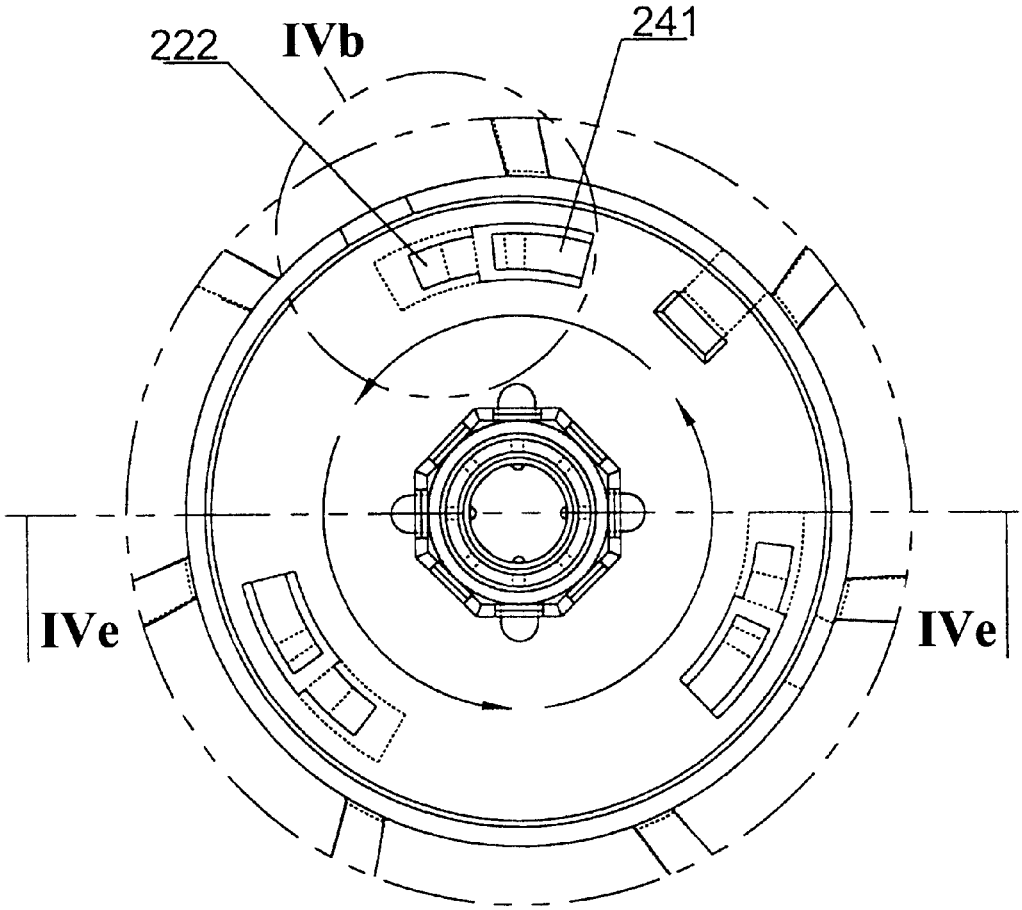
FIG. 4*a* is an elevation diagram of the first and second supports of the serial fan of the present invention before engaging with each other.
Figure 4B:
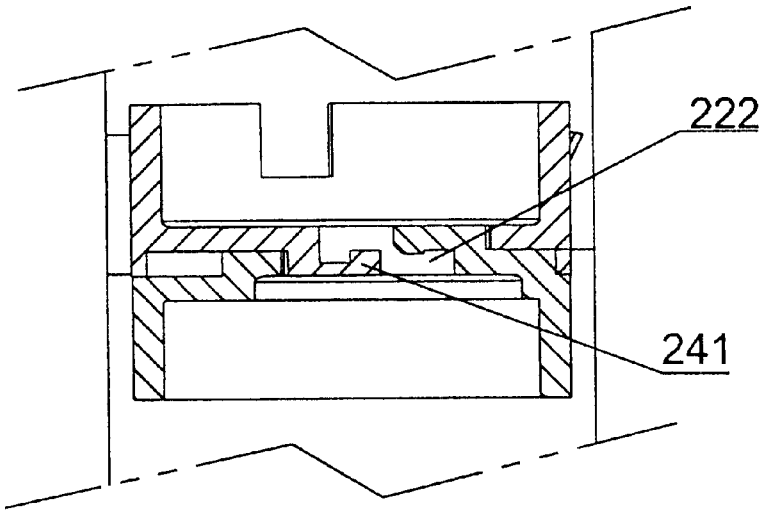
FIG. 4*b* is a longitudinally sectionally amplified diagram of the part IVb in FIG. 4*a;*
Figure 4C:
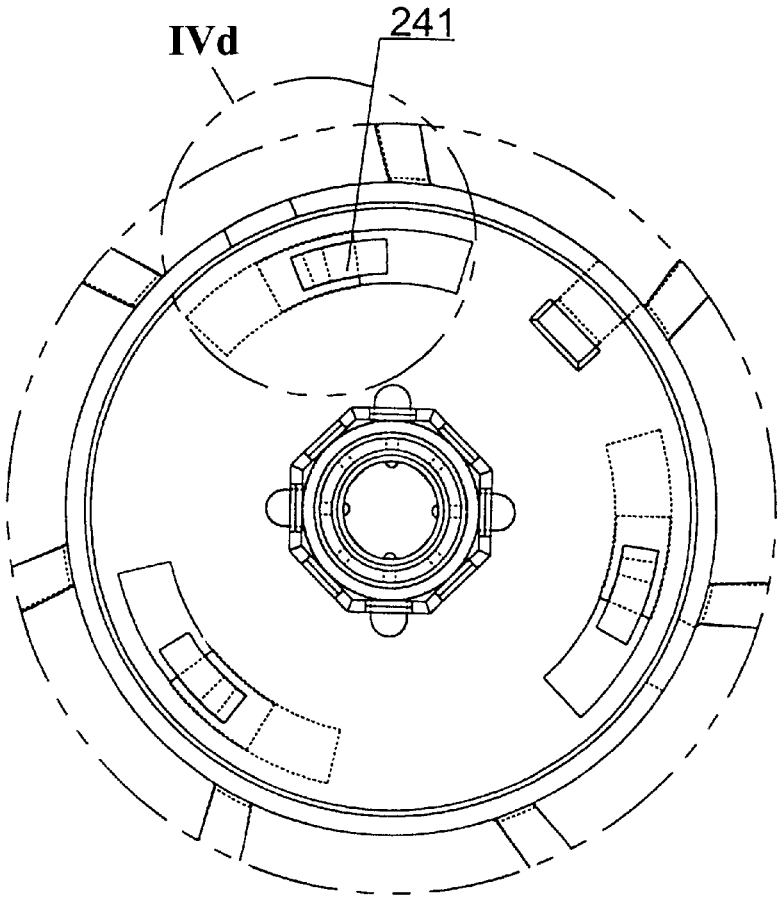
FIG. 4*c* is an elevation diagram of the first and second supports of the serial fan of the present invention after engaging with each other.
Figure 4D:
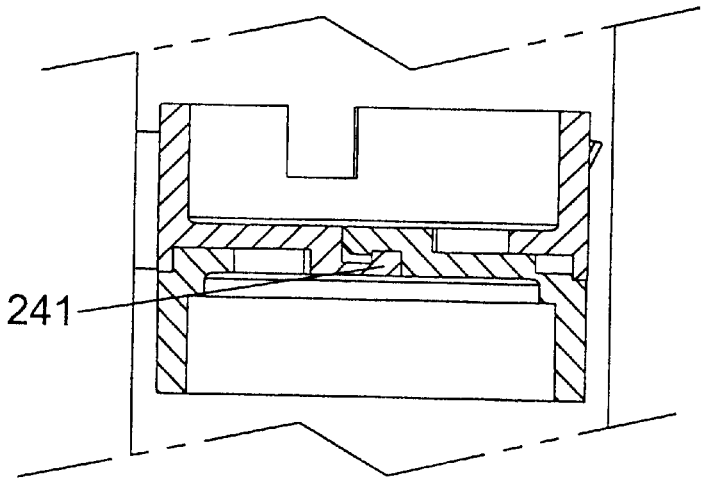
FIG. 4*d* is a longitudinally sectionally amplified diagram of the part IVd in FIG. 4*c;*

The first support 22 has a base and a hollow cylinder 221 substantially located at a center of the base for receiving the first motor 25 and the first rotor vane 26 therein in sequence. The second support 24 also includes a base and a hollow cylinder 242 substantially located at a center of the base for receiving the second motor 27 and the second rotor vane 28 therein in order. The second support can be made of plastic, metal or a material other than plastic and metal for a desired purpose. In addition, the base of the second support further has a plurality of hook structures 241 as shown in FIG. 3*a* or FIG. 3*b*, and the base of the first support 22 has a plurality of retaining grooves 222 corresponding to the shape and position of the hook structures 241 as shown in FIG. 4*a* or FIG. 4*b*. When assembling the second support 24 with the first support 22 together, the second support 24 is rotated along the arrow direction shown in FIG. 4*a* so that the first support 22 and the second support 24 can be tightly combined together through the engagement between the retaining grooves 222 and the hook structures 241 as shown in FIGS. 4*c* and 4*d*.

Figure 4E:
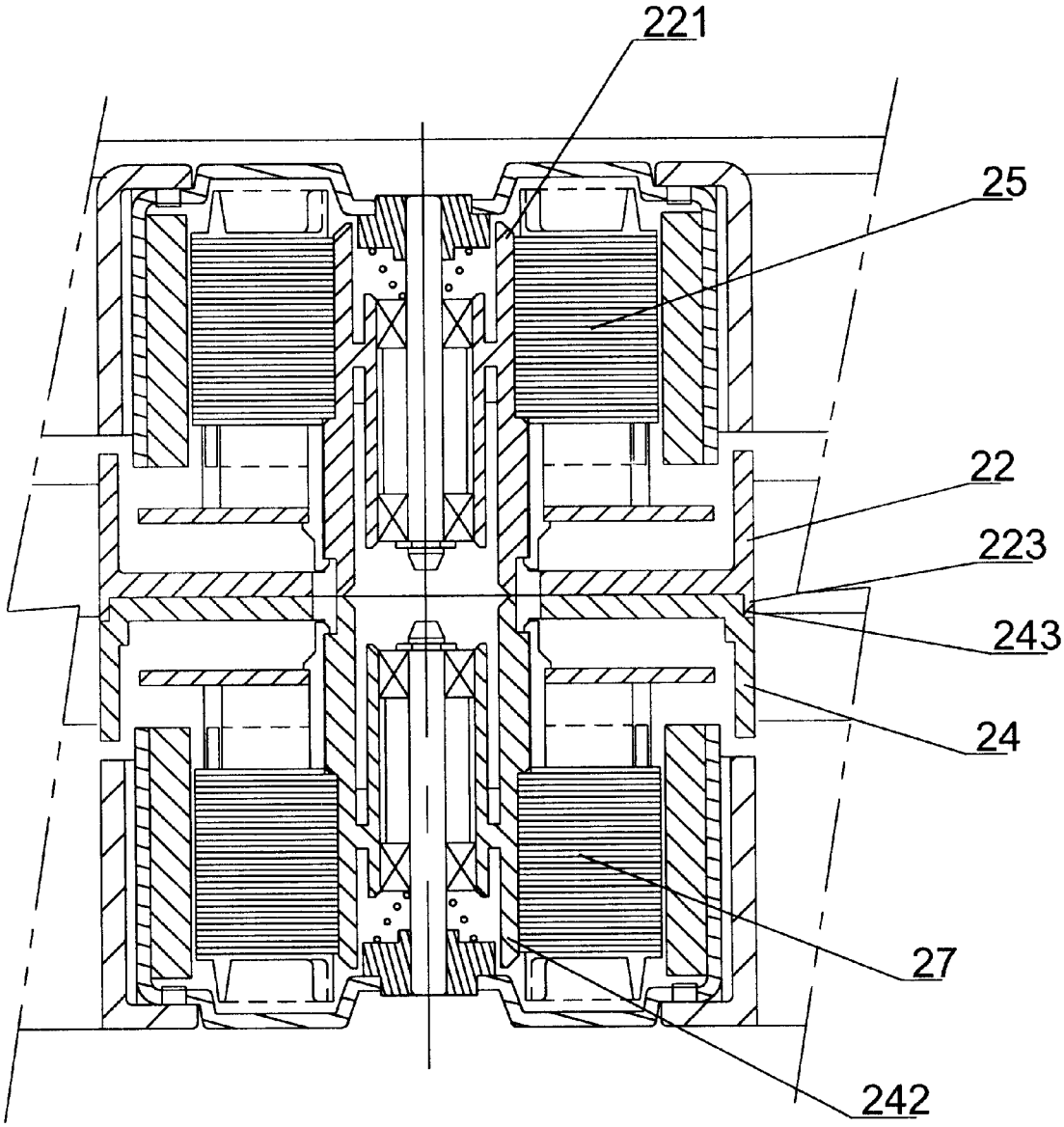
FIG. 4*e* is a longitudinally sectionally amplified diagram showing the assembly of the first and second supports, both of which have received a motor and a rotor vane thereon, respectively, taken along the line IVe—IVe in FIG. 4*a;*

Additionally, the base of the first support 22 has a flange 223 and the base of the second support 24 has an outwardly extended peripheral wall 243, the outer diameter of which is slightly smaller than the inner diagram of the flange 223 so that the bases of the first and second supports can be engaged with each other as shown in FIG. 4*e*. Thus, the combination of these two structures can further prevent the vibration on the direction perpendicular to the axial direction of the serial fan.

When the motor 25 for driving the first rotor vane 26 to rotate and the first rotor vane 26 are received by the first support 22 in sequence and then the second support 24 is engaged with the first support 22 to receive the motor 27 for driving the second rotor vane 28 to rotate and the second rotor vane 28, the assembly of the serial fan is completed and the first and second rotor vanes are connected in series within the main frame 21 along the axial direction of the serial fan.

Because the second support 24 is detachably connected with the first support 22, it is only necessary to telescope the base of the second support 24 onto the base of the first support 22 and rotate the second support 24 such that the first and second supports can be tightly combined together without needing any screws or other parts. Therefore, in comparison with the conventional serial fan, the serial fan of the present invention can be simply and fastly assembled and the cost of screws or other parts can be saved.

Figure 5:
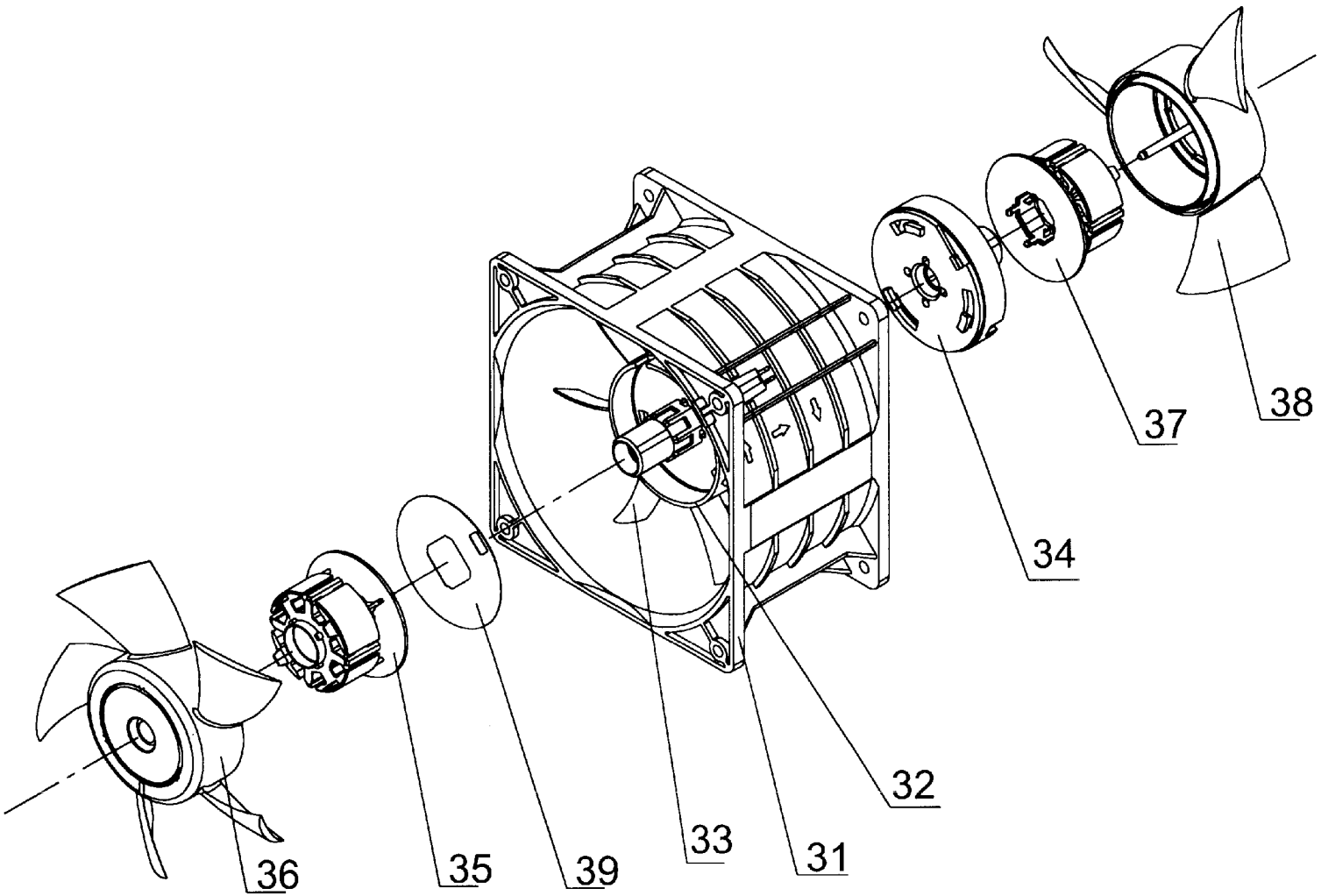
FIG. 5 is an exploded diagram showing the second preferred embodiment of a serial fan according to the present invention.

Now, please refer to FIG. 5 which shows another preferred embodiment of the present invention. The structure of this serial fan is substantially identical to that of the above-mentioned structure except that the serial fan further includes a separator. Because the distance between these two motors 35, 37 and that between the magnets (not shown) are relatively short after all components are assembled together, a separator 39 is disposed between these two motors 35, 37 for preventing a magnetic field interference between two adjacent motors.

Figure 6:
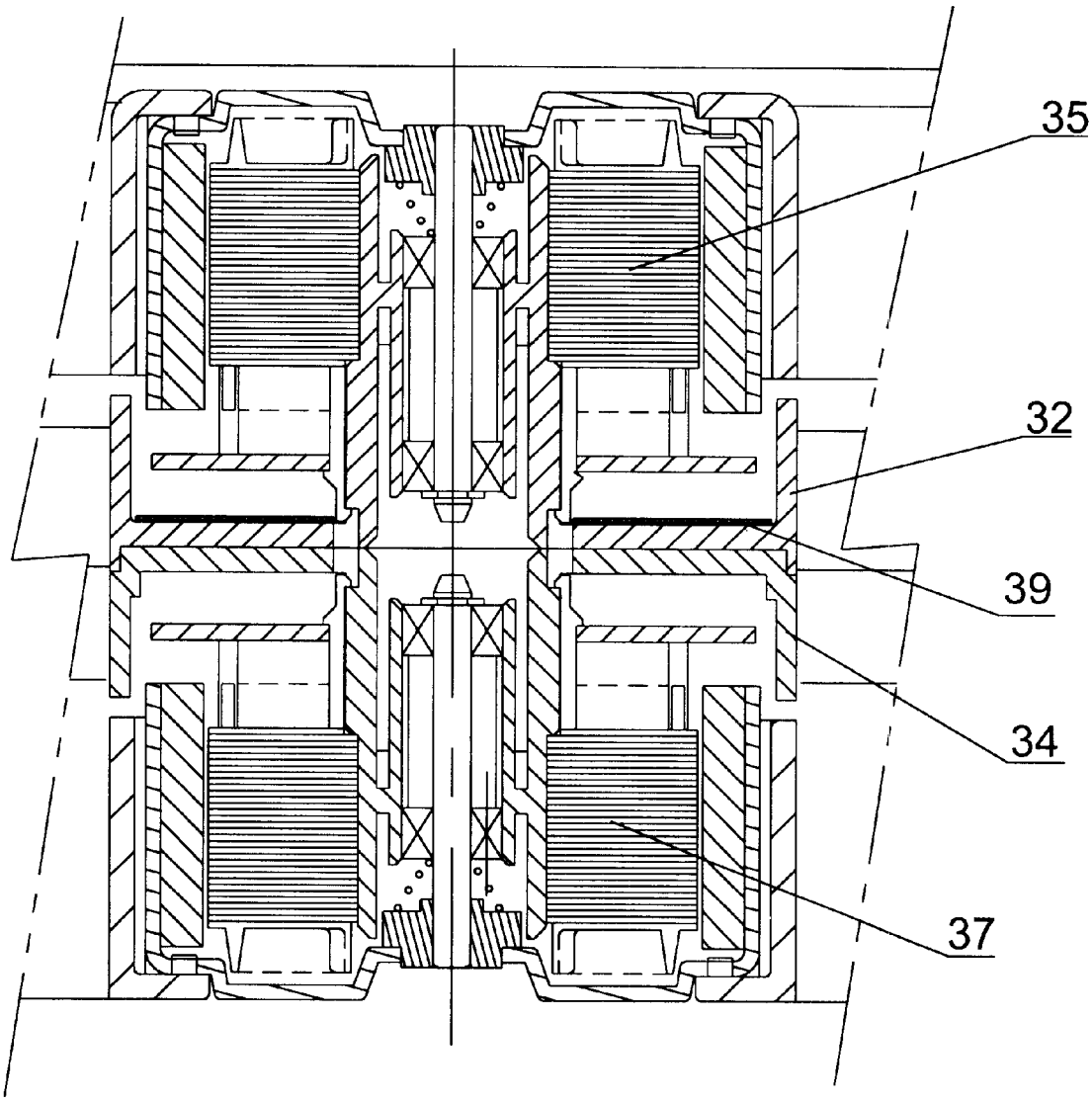
FIG. 6 is a partially longitudinally sectionally amplified diagram showing the assembly of the separator and the first and second supports, the latter two of which have received a motor and a rotor vane thereon, respectively, along the axis of the serial fan.

The separator 39 can be disposed between the first support 32 and the motor 35, between the second support 34 and the motor 37, or between the first support 32 and the second support 34. The separator can be made of any material with the function of isolating the magnetic field. Preferably, the separator is a metal plate. More preferably, the separator is an adhesive tape containing a metallic component, which can be cut into the shape and size substantially identical to the base of the first or second support to be directly attached to the base of the first support or the base of the second support (on the side of the support with the hollow cylinder or the opposite side facing the base of the other support). Please refer to FIG. 6 which shows the relative position of each component after the first support 32 receives the separator 39, the motor 35, and the first rotor vane 36 thereon and the second support 34 receives the motor 37 and the second rotor vane 38 thereon.

Certainly, the rotation speed, the rotation direction, the number of blades, and the tilting angles of blades of the first rotor vane can be identical to or different from those of the second rotor vane. These can be adjusted according to the actual requirement and application to attain the purpose of further enhancing the heat-dissipating efficiency of the serial fan. In addition, the structures of the first and second supports can be exchanged to achieve the same effect.

In conclusion, the present invention provides a serial fan which can be assembled easily, fastly and conveniently, and has a strengthened bonding structure. Not only can it save the cost of screws or other parts but reduce the assembling time. Additionally, in order to prevent the magnetic field interference between two adjacent motors resulting from too close between the two motors, the present invention further provides a separator to be disposed between two motors for effectively eliminating the magnetic field interference. Moreover, the present invention provides an axial-flow fan having a plurality of rotor vanes connected in series in a single fan guard (or main frame), and a plurality of guard blades radially arranged inside the main frame and fixed onto an inner surface of the main frame by each end thereof for connecting and fixing the first support 22 within the main frame 21, wherein each guard blade has a shape substantially identical to that of each of the rotor vanes, which can contribute to an increase in the discharged airflow pressure of the fan for enhancing its heat-dissipating efficiency.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A serial fan comprising:

a unitary main frame including a frame portion and a first support;

a plurality of rotor vanes connected in series within said unitary main frame along an axial direction of said serial fan, one of said plurality of rotor vanes being supported by said first support; and a second support detachably connected with said first support for supporting another one of said plurality of rotor vanes.

2. The serial fan according to claim 1 wherein said first support includes a first engaging member disposed on a base thereof and said second support includes a second engaging member disposed on a base thereof to be engaged with said first engaging member for tightly assembling said first support and said second support together.

3. The serial fan according to claim 2 wherein said first engaging member includes a plurality of retaining grooves formed on said base of said first support and said second engaging member includes a plurality of hook structures to be received by said plurality of retaining grooves, respectively.

4. The serial fan according to claim 2 wherein said first engaging member includes a plurality of hook structures formed on said base of said first support and said second engaging member includes a plurality of retaining grooves formed on said base of said second support to be engaged with said plurality of hook structures, respectively.

5. The serial fan according to claim 2 wherein said base of said first support has a flange and said base of said second support has an outwardly extended peripheral wall, said outwardly extended peripheral wall being circularly formed with an outer diameter, said flange being circularly formed with an inner diameter, the outer diameter of said outwardly extended peripheral wall of said second support being slightly smaller than the inner diameter of said flange of said first support such that said bases of said first and second supports are engaged with each other.

6. The serial fan according to claim 2 wherein said base of said second support has a flange and said base of said first support has an outwardly extended peripheral wall, said outwardly extended peripheral wall being circularly formed with an outer diameter, said flange being circularly formed with an inner diameter, the outer diameter of said outwardly extended peripheral wall of said first support being slightly smaller than the inner diameter of said flange of said second support such that said bases of said first and second supports are engaged with each other.

7. The serial fan according to claim 1 further comprising a plurality of motors respectively received by said first and second supports for driving said plurality of rotor vanes to rotate.

8. The serial fan according to claim 7 wherein said first support has a base and a hollow cylinder substantially located at a center of said base for receiving one of said plurality of motors and said one of said plurality of rotor vanes.

9. The serial fan according to claim 8 wherein said second support further includes a hollow cylinder substantially located at a center of a base thereof for receiving another one of said plurality of motors and said another one of said plurality of rotor vanes.

10. The serial fan according to claim 9 wherein said second support is made of a material selected from one group consisting of plastic and metal.

11. The serial fan according to claim 1 wherein said first support is connected with said main frame through a plurality of guard blades radially arranged inside said main frame and fixed onto an inner surface of said main frame by each end thereof.

12. The serial fan according to claim 11 wherein each of said plurality of guard blades has a shape substantially identical to that of each blade of said plurality of said rotor vanes for enhancing a heat-dissipating efficiency.

13. The serial fan according to claim 11 wherein said first support, said main frame and said plurality of guard blades are integrally formed together.

14. The serial fan according to claim 11 wherein said first support, said main frame and said plurality of guard blades are made of a material selected from one group consisting of plastic and metal, respectively.

15. The serial fan according to claim 1 being an axial-flow fan.

16. A serial fan comprising:

a main frame;

a plurality of rotor vanes connected in series within said main frame along an axial direction of said serial fan;

a first support formed inside and connected with said main frame for supporting one of said plurality of rotor vanes;

a second support detachably connected with said first support for supporting another one of said plurality of rotor vanes;

a plurality of motors respectively received by said first and second supports for driving said plurality of rotor vanes to rotate; and a separator having means for preventing a magnetic field interference between said plurality of motors.

17. The serial fan according to claim 16 wherein said separator is disposed between one of said first and second supports and one of said plurality of motors.

18. The serial fan according to claim 16 wherein said separator is disposed between said first support and said second support for preventing a magnetic field interference between said plurality of motors.

19. The serial fan according to claim 16 wherein said separator is a metal plate.

20. The serial fan according to claim 16 wherein said separator is an adhesive tape containing a metallic component to be directly attached to a base of said first support.

21. The serial fan according to claim 16 wherein said separator is an adhesive tape containing a metallic component to be directly attached to a base of said second support.

22. A serial fan comprising:

a unitary main frame including a frame portion and a first support;

a plurality of rotor vanes connected in series within said unitary main frame along an axial direction of said serial fan, one of said plurality of rotor vanes being supported by said first support; and a second support connected with said first support for supporting another one of said plurality of rotor vanes.

23. The serial fan according to claim 22 further comprising a plurality of motors respectively received by said first and second supports for driving said plurality of rotor vanes to rotate.

24. The serial fan according to claim 23 wherein said first support has a base and a hollow cylinder substantially located at a center of said base for receiving one of said plurality of motors and said one of said plurality of rotor vanes.

25. The serial fan according to claim 24 wherein said second support further includes a hollow cylinder substantially located at a center of a base thereof for receiving another one of said plurality of motors and said another one of said plurality of rotor vanes.

26. The serial fan according to claim 25 wherein said second support is made of a material selected from a group consisting of plastic and metal.

27. The serial fan according to claim 23 further comprising a separator for preventing a magnetic field interference between two adjacent motors.

28. The serial fan according to claim 27 wherein said separator is a metal plate.

29. The serial fan according to claim 27 wherein said separator is an adhesive tape containing a metallic component to be directly attached to a base of said first support.

30. The serial fan according to claim 27 wherein said separator is an adhesive tape containing a metallic component to be directly attached to a base of said second support.

31. The serial fan according to claim 22 wherein said first support is connected with said main frame through a plurality of guard blades radially arranged inside said main frame and fixed onto an inner surface of said main frame by each end thereof.

32. The serial fan according to claim 31 wherein each of said plurality of guard blades has a shape substantially identical to that of each blade of said plurality of said rotor vanes for enhancing a heat-dissipating efficiency.

33. The serial fan according to claim 31 wherein said first support, said main frame and said plurality of guard blades are integrally formed together.

* * * * *